United States Patent [19]

Coombs et al.

[11] 4,330,114

[45] May 18, 1982

[54] SHEET DELIVERY APPARATUS WITH HORIZONTAL PLATE

[76] Inventors: Peter M. Coombs, P.O. Box 311, Wilton, N.H. 03858; Gary W. Playdon, 22 Henry Taylor St., Salem, N.H. 03079; Jeffrey J. Koczela, New Boston Rd., Goffstown, N.H. 03045

[21] Appl. No.: 144,248

[22] Filed: Apr. 28, 1980

[51] Int. Cl.[3] ..... B65H 3/30

[52] U.S. Cl. ..... 271/22; 271/117; 271/126; 271/160; 271/170

[58] Field of Search ..... 271/21, 22, 24, 117, 271/121, 126, 160, 164, 170

[56] References Cited

U.S. PATENT DOCUMENTS

| | | | |
|---|---|---|---|
| 3,724,839 | 4/1973 | Suzuki | 271/117 |
| 3,806,112 | 4/1974 | Melby | 271/10 |
| 3,831,931 | 8/1974 | Tsukamoto | 271/160 X |

*Primary Examiner*—Richard A. Schacher

*Attorney, Agent, or Firm*—Kenway & Jenney

[57] ABSTRACT

A large capacity sheet delivery apparatus mounted on a photocopier has an upwardly biased, horizontal stack plate and movable feed rollers, rotated by a drive in the photocopier, that continue to engage the top sheet of the stack as the feed position of the top sheet lowers due to removal of sheets from the stack. A sheet stripping mechanism engages the feed roller assembly and is movable with it. The horizontal plate has linear bearings mounted on its rear edge for sliding on a pair of vertical rods.

2 Claims, 13 Drawing Figures

SHEET DELIVERY APPARATUS WITH HORIZONTAL PLATE

BACKGROUND OF THE INVENTION

This invention relates generally to sheet delivery systems and particularly to apparatus for holding a large stack of sheets on a horizontal plate for delivery one at a time to an apparatus such as a photocopier.

Most photocopiers in use today have systems for storing a stack of transfer sheets from which the sheets are fed, one at a time, to the photocopier for image transfer. Typically the sheet stack is held on a movable platform, so that as sheets are removed from the stack the feed position of the top sheet is held nearly constant. Feed rollers mounted in the system engage the top sheet at this fixed feed position. An example of such a system is shown in U.S. Pat. No. 4,032,137. The patent shows springs maintaining a bias on a plate on which the transfer sheets are stacked. The springs are selected so that as sheets are fed from the stack, the feed position of the top sheet remains the same.

The major problem in any sheet feeding apparatus is feeding sheets from the stack one at a time. This problem usually manifests itself in two sheets (or more) being stripped from a stack rather than one, with the multiple sheets being either in exact registration or with one slightly trailing the other (the shingle effect). The problem may be caused by slight variations in paper size, thickness, and texture, or by variations in ambient conditions such as humidity. Another problem in feeding sheets is maintaining the sheets in a straight path during the feeding operation. The reliability of the sheet feeding system is an important characteristic of the system, and makes departures from the designs of conventional systems difficult to consider.

The advent of high speed photocopiers means that transfer sheets are used at a rapid rate, so that storage of a large number of sheets in the sheet delivery system is desirable to avoid the inconvenience of frequent loading. It is difficult to calibrate the springs and arrange for a constant feed position for the top sheet of a large stack of paper (e.g., one containing two reams of paper) in a system like the one referred to above. Generally a much more elaborate system is required than the biased plate system to maintain the top sheet of a large stack of stored sheets at a fixed feed position. The more elaborate such a system is, the more expensive and difficult to maintain it is. Many copiers have cassettes with holding capacities of only 250 to 500 sheets because that is the limit of what can be provided inexpensively. To the extent that an inexpensive larger capacity apparatus (one holding up to 1000 sheets, for example) may be devised, it would be desirable to have such an apparatus that can replace cassettes in existing photocopiers.

In patent application Ser. No. 76,575, filed Sept. 18, 1979, now abandoned in favor of continuation application Ser. No. 284,234, assigned to the assignee of the present application, a sheet delivery system responding to these problems is disclosed. In the system disclosed therein, the front end of a pivoting plate on which a sheet stack is supported rises under the influence of springs, but not enough to wholly compensate for the reduction in stack size. Accordingly, the feed rollers and sheet stripping mechanism are arranged to drop down to lower operating positions as the stack diminishes in height. As the pivoting plate of that system pivots about its rear edge, the stack size is reduced, the angle increases between the plate and the horizontal, and the angle at which the top sheet of the stack approaches the feeding mechanism also increases. The sheet stripping mechanism of the system has to be able to function, therefore, on top sheets approaching it through a range of angular positions.

Accordingly, principle objects of this invention are to provide a large capacity sheet delivery apparatus, for use with a device such as a photocopier, that has increased reliability in sheet delivery, and is also simple and inexpensive to manufacture and maintain.

Another object of the invention is to increase the sheet storage capacity of an existing photocopier by providing an add-on apparatus that is simple and inexpensive as well as reliable.

Other objects will be apparent in the folowing description and will be either explicitly stated or be inherent in the description.

SUMMARY OF THE INVENTION

The invention comprises a sheet feeding apparatus for a photocopier, that has an upwardly biased horizontal plate for supporting a sheet stack, movable feed rollers that feed sheets from the top of the sheet stack from a continuum of feed positions and that are also movable to an inoperative position, and a sheet stripping mechanism that is movable in response to the feed rollers. The sheet stack support plate is vertically movable in response to the weight of the sheet stack and the force of the feed rollers bearing on the stack. The biasing members applying the upward bias to the plate have an effective spring constant that is less than a "constant feed position force," so that as the number of sheets in the stack decreases, the plate moves upwardly less than the thickness of the removed sheets, the feed position lowers, and the feed rollers and sheet stripping mechanism lower with it.

In a preferred embodiment of the invention, the horizontal plate has linear bearings on its rear portion which are slidably mounted on vertical rods fixed to a base of the sheet feeding apparatus so that the plate is mounted in a cantilever fashion on the rods.

DESCRIPTION OF THE DRAWINGS

Other objects, features and advantages of the invention will be apparent from the following description of a preferred embodiment, including the drawings, in which.

DESCRIPTION OF A PREFERRED EMBODIMENT

Figure 1:
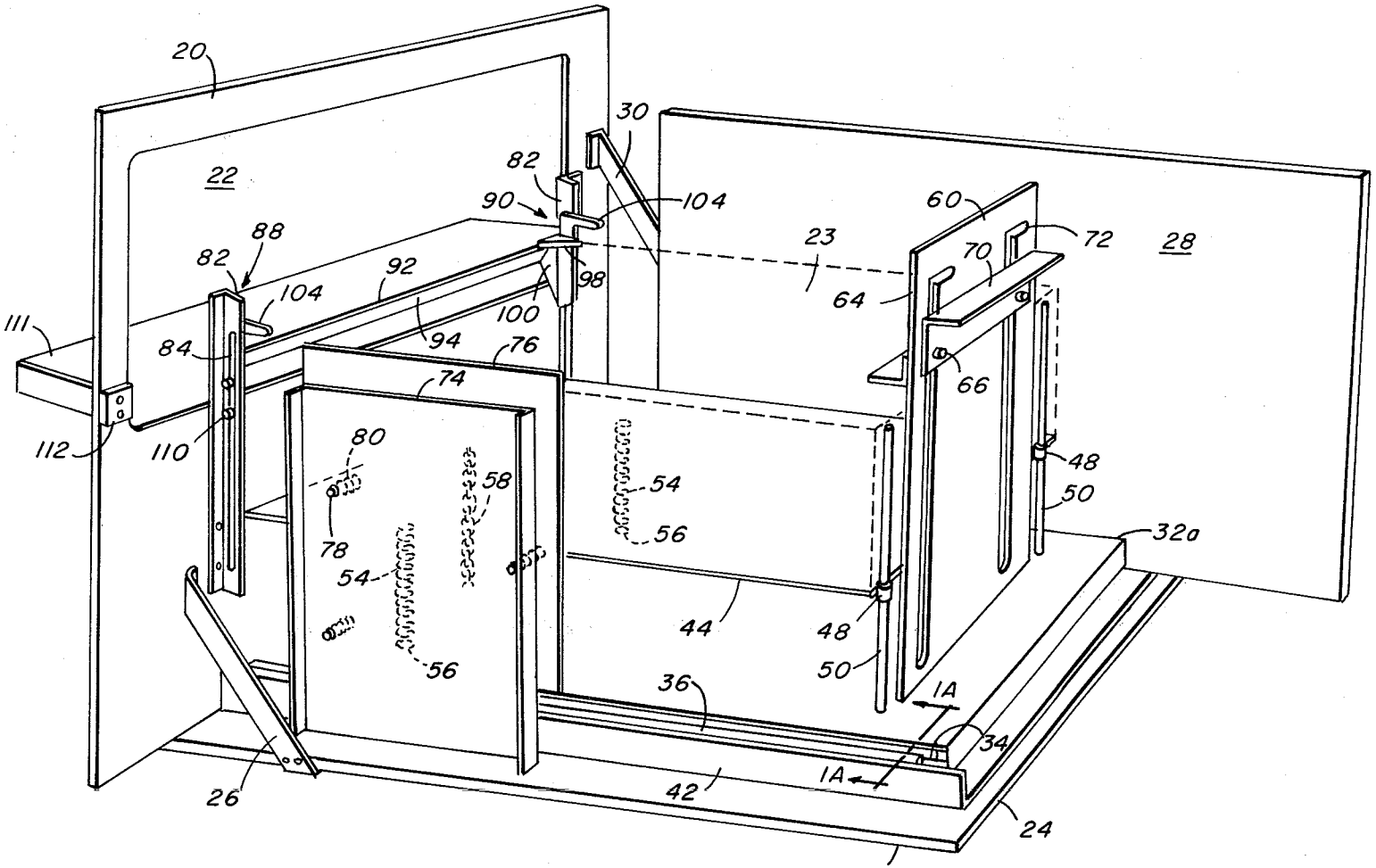
FIG. 1 is a perspective view of a sheet supporting assembly according to the invention.
Figure 1A:
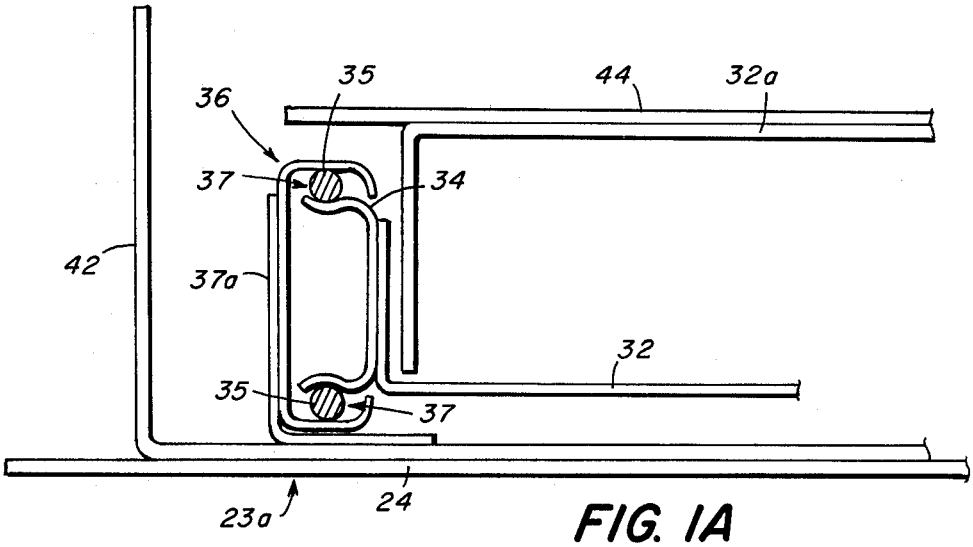
FIG. 1A is a detailed sectional view of the bracket and channel assembly between the movable base and the base plate of the assembly shown in FIG. 1.

Referring to FIG. 1, there is shown a vertical support plate 20 of a photocopier apparatus and a window or opening 22 in the support plate through which sheets of a transfer material 23 are to be fed one at a time. A sheet supporting assembly 23*a*, for supporting sheets 23, is secured to the vertical support plate 23, in alignment with opening 22. The sheet supporting assembly has a base plate 24 which extends rearwardly and horizontally from the support plate 20, and which is supported by a bracket 26 connected to both plate 20 and plate 24. A vertical guide plate 28 extends rearwardly from the support plate 20 and is connected to the base plate 24 by means not shown. Vertical plate 28 is connected by a bracket 30 to the support plate 20. The guide plate 28 has a height at least as high as the height of a maximum stack of the transfer material intended to be supported by the sheet supporting assembly and extends rearward at least as far as base plate 24. A rectangular horizontal movable base 32 supports a sheet stack positioning assembly for sliding movement toward and from support plate 20. Base 32 has brackets 34 extending from each side, and wheels 35 fixed in the brackets that roll in channels 36 supported by the base plate 24 (see FIG. 1A), so that the base 32 is slidable toward and away from the support plate 20. A short guide plate 42 extends along the left side of the illustrated sheet holding assembly and is secured to the base plate 24 by means not shown.

The sheet supporting assembly 23*a* also includes a horizontal stack plate 44 for receiving the stack of sheets 23. The stack plate 44 has mounted on its rear edge 46 a pair of linear bearings 48. The linear bearings 48 are slidably mounted on a pair of vertical rods 50 fixed to the base 32 so that the horizontal stack plate 44 is effectively mounted in cantilever fashion on the vertical rods 50. The bearings 48 have an exterior casing 51 within which bearing balls 52 are contained for slidable, rotatable contact with the rods 50 (see FIG. 9), allowing relatively smooth and easy movement of the stack plate 44 in the vertical direction while restraining its movement in the horizontal plane.

A pair of springs 54 extend from plugs 56 on the base 32 to the underside of the front portion of the stack plate 44. A chain 58, fastened at the ends to the base 32 and the underside of the stack plate 44 forward of the springs 54, limits the upward movement of the stack plate 44 to avoid disengagement or distortion of the springs 54. A stack of sheets 23, shown in outline form by dotted lines in FIG. 1, is stacked on the stack support plate 44.

A rear guide plate 60 extends vertically from the base 32 near the rear edge 46 of the stack plate 44. A rear inner tab 62 is vertically slidable on a forward face 64 of the rear guide plate. The illustrated rear inner tab 62 is roughly L-shaped in cross section with a horizontally forwardly extending lower strip 65. The rear inner tab 62 extends horizontally the width of the rear guide plate and is connected by fasteners 66 through vertical slots 68 in the rear guide plate 60 to a rear outer tab 70. This allows manipulation of the rear inner tab 62 by the outer tab 70. Each rear guide vertical slot 68 terminates at the top with a horizontal slot portion 72 which allows the tabs 62, 70 to be releasably positioned in a raised position. When the tabs 62, 70 are not positioned in the horizontal slot portions 72, they can be moved to a lower position to allow the forward, lower strip 65 of the rear inner tab 62 to bear on top of the rear of the stack of sheets 23 supported on the stack plate 44.

The sheet supporting assembly 23*a* further has a vertically extending edge plate 74 laterally spaced from sheets 23 and mounted on the base plate 24 (by means not shown). The vertical plate 74 extends as high as the stack of sheets 23 is designed to reach, and is located along the forward edge portion of the sheet stack 23. A vertically extending, spring plate 76 corresponding in size generally to the vertical plate 74 is mounted on the vertical plate 74 by fasteners 78 (FIG. 10) for movement in the lateral direction. Fasteners 78 have resilient spring members 80 for biasing the spring plate toward sheets 23. The constant biasing force exerted by spring plate 76 against the edges of sheets 23 urges alignment of sheets 23 against plate 28 and defines the left edge position of the sheets when properly stacked.

Figures 4, 5, 6, 7, 8, 9, 10:
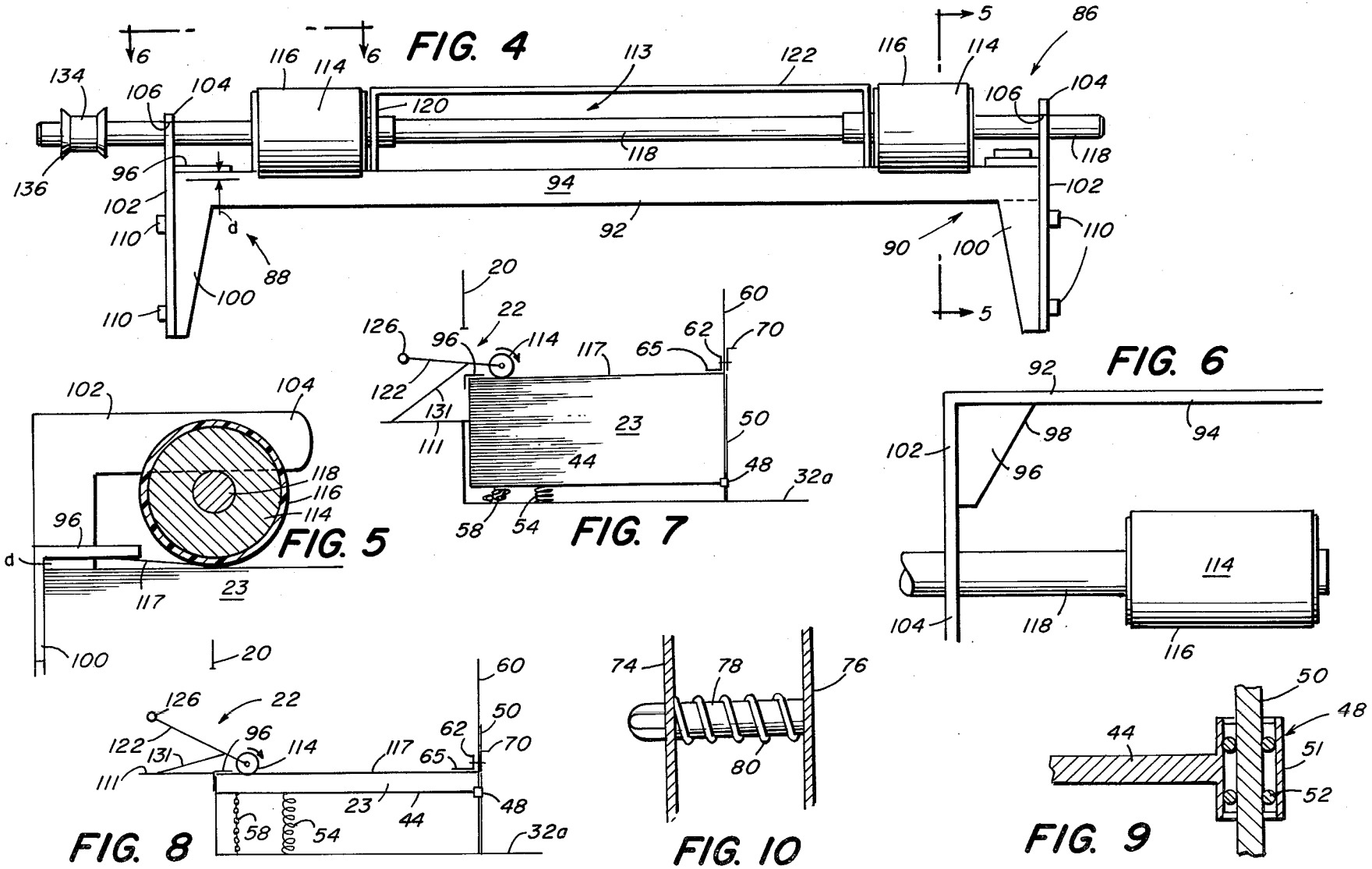
FIG. 4 is a rear elevation view of the sheet stripping mechanism and associated feed roller assembly.
FIG. 5 is a cross-sectional view of the sheet stripping mechanism and associated feed roller assembly along the lines 5—5 of FIG. 4.
FIG. 6 is a plan view of the sheet stripping mechanism and associated feed roller assembly along the lines 6—6 of FIG. 4.
FIG. 7 is a diagrammatic elevation view of the sheet supporting assembly of FIG. 1 with the feed roller in place atop a full load of material.
FIG. 8 is a view like that of FIG. 7 with a stack of only a few sheets.
FIG. 9 is a detailed sectional view showing the connection of the horizontal support plate of the sheet supporting assembly to the plate support rods of the apparatus of FIG. 1.
FIG. 10 is a detailed sectional view of a fastener joining an edge plate and spring plate of the sheet supporting assembly.

Corner angle members 82 are connected to support plate 20 and extend vertically on either side of the opening 22 of the support plate 20. The corner angle members 82 have vertical slots 84 for slidably guiding a sheet stripping mechanism 86 (FIG. 4). Referring to FIGS. 4, 5 and 6 in particular, the mechanism 86 can be seen to have a left portion 88 and a right portion 90 which are connected by a horizontally directed bar 92 extending substantially across the width of window 22 of the support plate 20. The bar 92 has a vertical rearward face 94. Each portion 88, 90 has a horizontal, triangular shaped sheet stripping tab 96 extending rearwardly from the top of the bar 92, with a diagonal edge 98 extending from the bar 92 to the corner angle member 82. A lower sheet stop portion 100 projects downwardly from the bar. A vertical side portion 102 of each portion 88, 90 includes a rearwardly projecting elevator tab 104 at the top, with a lower ramped surface 106. The sheet stripping mechanism 86 includes projecting fasteners 110 (FIG. 1) with bushings to slidably engage the corner angle slots 84.

A planar, generally horizontal, guide plate 111 is mounted inside the opening 22 (that is, within the machine) by brackets 112 for guiding paper fed through the opening.

Figure 2A:
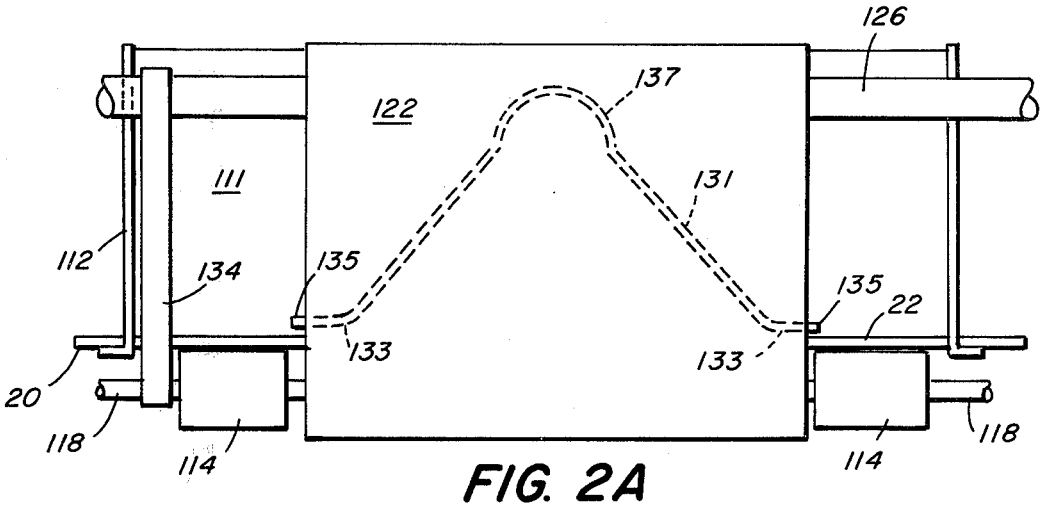
FIG. 2A is a diagrammatic plan view of the pivot plate, deflector wire and guide plate of the assembly.
Figure 2B:
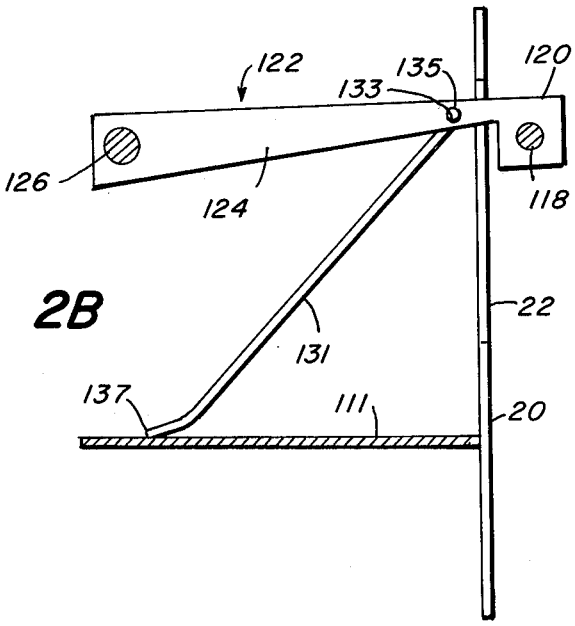
FIG. 2B is a diagrammatic side elevational view of the elements of FIG. 2A.
Figures 2, 3:
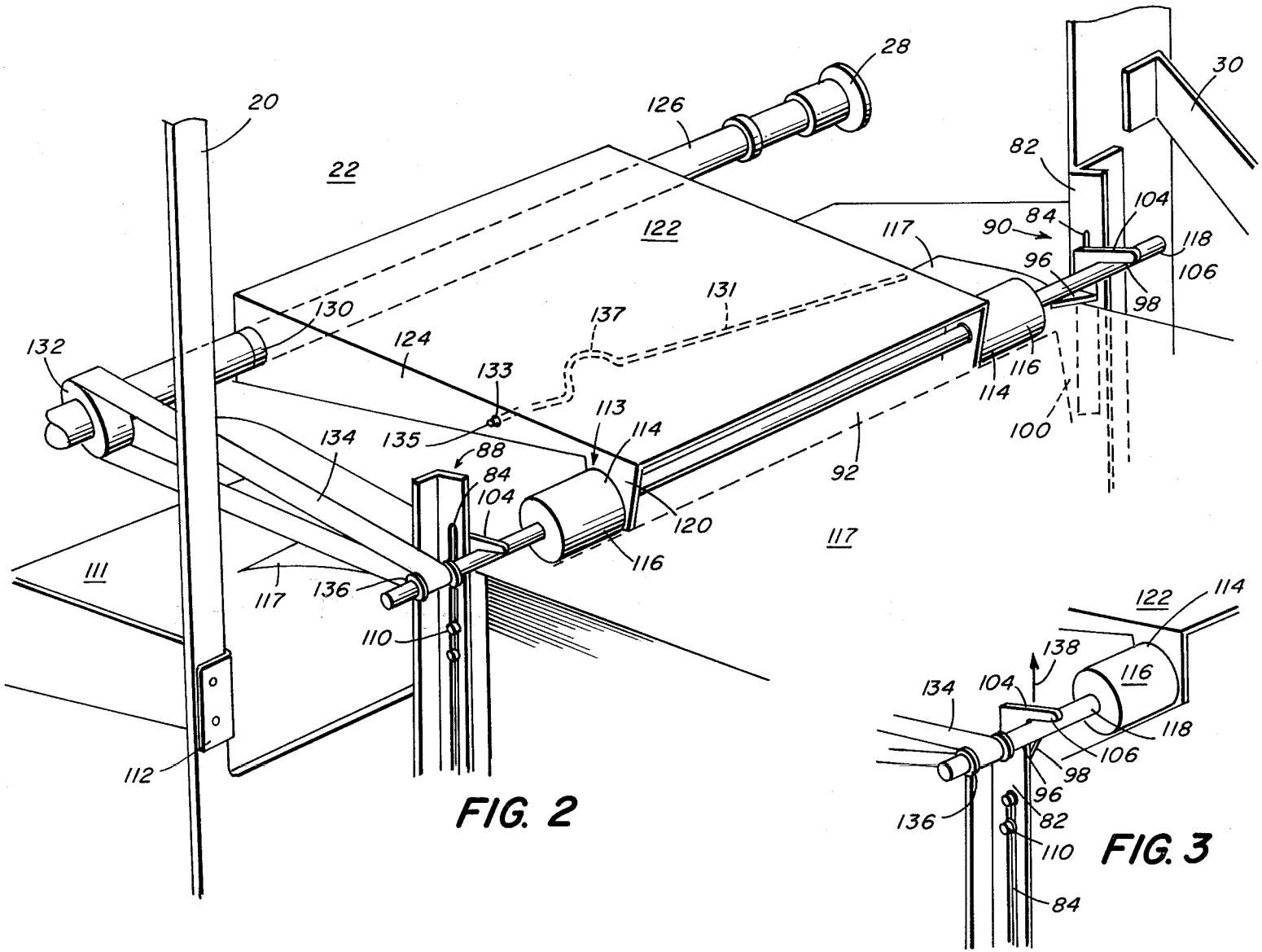
FIG. 2 is a perspective view of a sheet stripping mechanism of the sheet supporting assembly of FIG. 1 in operative engagement with a portion of a feed roller assembly according to the invention.
FIG. 3 is a detailed perspective view of the sheet stripping mechanism and associated feed roller assembly of FIG. 2 in a raised position.

FIG. 2 shows a feed roller assembly 113 having feed rollers 114 each having a rubber surface 116 for contacting the forward portion of a top sheet 117 on top of the stack 23. The rollers are secured to a horizontally extending shaft 118. The feed rollers 114 are located so that they bear on the top sheet 117 vertically forwardly of the forward springs 54 extending between the stack plate 44 and the movable base 32. The rollers 114 contact the top sheet rearwardly of the sheet stripping tabs 96. The shaft 118 extends beneath the ramped surfaces 106 of the elevator tabs 104 of the sheet stripping assembly 86 and through downwardly extending ear portions 120 of a rigid connector pivot plate 122. The connector plate extends generally in the forward direction and includes gussets 124 on each side through which a remote drive shaft 126 rotatably extends. The drive shaft 126 also extends through support structure of the copier (not shown) so that its axis is fixed. Mounted on shaft 126 is a drive wheel 128 driven by a drive mechanism of the copier not shown. The drive mechanism may serve different functions in the copier, unrelated to the feed rollers. The drive shaft 126 includes bushings 130 where it passes through the gussets 124 so that the drive shaft is freely rotatable with respect to the plate 122. A belt drive wheel 132, secured on the drive shaft 126, drives a belt 134 around a drive wheel 136 secured on the feed roller shaft 118. The two wheels 132, 136 are appropriately sized to provide the desired speed for the feed roller shaft in relation to the drive mechanism of the copier. Thus the feed rollers 114 may easily be rotatably driven by a drive mechanism or drive shaft of a copier to which the sheet feeding apparatus is added, even if the copier was not designed for the apparatus.

A deflector wire 131 extends downwardly from ends 133 passing through holes 135 in the pivot plate gussets 124. The wire 131 is freely pivotable about the ends 133 in the plate holes 135. The wire 131 extends from these ends 133 inwardly and downwardly toward the guide plate 111 where its central portion 137 rests on the guide plate. (FIGS. 2A and 2B show the relative location of the deflector wire 131 vis-a-vis the pivot plate 122 and the guide plate 111.) In the illustrated embodiment the deflector wire 131 is made from No. 32 piano wire.

The feed roller shaft 118 is engageable by a lever not shown in the drawing so that the feed roller assembly 113 can be moved upwardly (in the direction of the arrow 138 shown in FIG. 3). FIG. 3 shows the feed roller 114 in such a raised position, which clears the feed roller assembly 113 from engagement with the sheet stack 23, such disengagement being desirable when the sheet supporting assembly is moved rearwardly to replenish the sheet stack 23. The feed roller shaft 118 and the connector pivot plate 122 through which it extends are pivoted about drive shaft 126 as the feed roller assembly is disengaged from the sheet stack 23. As the feed roller shaft 118 is moved upwardly it pulls up the sheet stripping mechanism 86 by engaging the elevator tabs 104. The upward movement of the sheet stripping mechanism 86 disengages the mechanism, along with the feed roller assembly from the stack 23.

FIGS. 4, 5 and 6 show in greater detail the relationship between the feed roller assembly 113 and the sheet stripping mechanism 86. As shown in FIG. 5, the feed roller 114 bears on the top sheet 117 at a line behind the sheet stripping tab 96. The ramped surface 106 of the sheet stripping mechanism elevator tabs 104 rests on the feed roller drive shaft 118 when the feed roller 114 is in contact with the top sheet 117 so that the sheet stripping tab 96 is a short distance above the top sheet. This distance, shown by the reference letter d in FIG. 5, is about 0.040 inch in the illustrated embodiment.

FIGS. 7 and 8 show diagrammatically the relationship between the elements of the sheet delivery apparatus when the stack 23 is of different heights. FIG. 7 shows a stack 23 of the maximum sheet load that the system can handle. The stack plate 44 is correspondingly pressed down against the force of the springs 54 to its bottom position. The stack 23 is held down by the weight of the rear inner tabs 62, 70 bearing on the rear of the stack, to prevent forward "creep" of the stack. The sheet stripping tab 96 is shown near the front of the top sheet 117. The feed rollers 114 bear on the top sheet 117; the feed rollers are pivotable about the remote drive shaft 126 by way of the connector pivot plate 122.

FIG. 8 shows the same apparatus with only a few sheets in the stack 23. Accordingly, with reduced weight on the stack plate 44 from the sheet stack 23, the plate has moved vertically upwardly. However, the springs 54 are calibrated so that they do not maintain a constant sheet feed position for the top sheet 117 on top of the stack 23. As sheets are removed from the stack, the position of the top sheet 117, the sheet feed position, is substantially lowered. Accordingly, the feed rollers 114 must drop lower also. The sheet stripping tabs 96 of the sheet stripping mechanism 86 also lower themselves. (For the last few sheets of the stack 23, the position of the sheet stripping tabs 96 is very close to the bottom of the opening 22.) The stack plate 44 moves up as sheets are fed from the stack.

In operation, the sheet delivery apparatus is loaded by moving the feed roller shaft 118 and the feed roller assembly 113 upwardly. The shaft 118 is moved in the direction of arrow 138 to an inoperative position where the feed rollers 114 are disengaged from the stack 23 in the sheet holding assembly 23*a*. The sheet stripping assembly 86 is also moved upwardly to an inoperative position by virtue of the engagement of the shaft 118 with the elevator tabs 104. With the feed roller assembly and the sheet stripping mechanism out of engagement with the stack, the stack plate 44 on which the sheets are loaded is moved back by sliding back the movable base 32.

After the base 32 is pulled back, the rear outer tab 70 is pulled up the vertical slots 68 of the rear guide plate 60, until the fasteners 66 are brought to rest in the horizontal slot portion 72. Additional paper may then be placed on the stack plate 44, the weight of the paper forcing down the plate 44 against the pressure of the springs 54. The rear inner tab 62 may then be released to slide down the inner face of the rear guide plate 60 and rest on the back of the sheet stack 58. The base 32 is then pushed forward until the stack reaches the sheet stop portions 100 of the sheet stripping mechanism 86.

The feed rollers 114 are then released to drop down to an operative position where they bear on the top sheet 117 of the stack 23. The sheet stripping mechanism 86 also slides down the slots 84 of the corner angles 82 so that the ramped surfaces 106 of the elevator tabs 104 rest atop the feed roller shaft 118. The sheet stripping tabs 96 are then located a distance, about 0.040 inch in this embodiment, above the top sheet 117.

The spring plate 76 urges any sheets in the stack 23 that have a tendency to move laterally, toward the vertical guide plate 28 at the opposite side of the assembly thereby aligning the stack with the plate 28. The rear tabs 62, 70 have a combined weight, in the illustrative embodiment between 4.6 and 4.7 ounces, that is chosen to exert a pressure on the rear of the sheet stack sufficient to counteract the tendency of the sheets in the stack 23 to "creep" forward under this influence of feed roller activity.

During the sheet feeding process the rollers 114 contacting the top sheet 117 pull it forward. The sheet 117 then is caught beneath the sheet stripping tabs 96 and further forward pressure from the feed rollers 114 causes the corners of the sheet 117 to move inward toward the center, causing the sheet to buckle. Finally, the sheet corners escape past the diagonal edges 98 of the sheet stripping tabs 96, in the process disengaging the top sheet from those below it in the stack.

After a sheet 117 is brought forward past the sheet stripping tabs 96, it passes through the opening 22 where it meets the deflector wire 131 and is deflected downwardly toward the guide plate 111. The engagement of the sheet 117 by the deflector wire 131 helps prevent "skew" of the sheet and thus maintains it in its correct path through the photocopier.

As sheets are fed by the rollers 114 from the top of the stack 23 through the opening 22, the number of sheets in the stack decreases and the downward force on the ramp support plate 44 accordingly decreases. (The downward force also includes the force of the feed rollers 114 bearing on the stack 23.) The stack plate 44 moves upwardly in response to the springs 54 extending between it and the movable base 32. The springs 54 are not calibrated, however, to move the plate upward a distance that compensates completely for the reduction in height of the sheet stack. A spring constant that would compensate for the reduction in height might be called a "constant feed position force," because its effect would be to keep the top sheet of the stack at a nearly constant feed position no matter how many sheets were removed from the stack. The springs 54 of the illustrated embodiment are selected to exert a force substantially less than the "constant feed position force," so that as sheets are fed from the stack, the position of the top sheet, or the sheet feed position, continuously lowers from a first position like that shown in FIG. 7, through intermediate positions, to a second, lowest, position in which only one sheet is left and the feed position is at its lowest point (below the position shown in FIG. 8, showing the stack with a few sheets).

The feed rollers 114 also lower from a first position in which they feed top sheets at the first feed position, through a continuum of intermediate positions, to a lowest second position in which they feed a sheet from the second lowest sheet feed position. As the rollers 114 drop, the connector pivot plate 122 pivots downwardly about the drive shaft 126. The sheet stripping assembly 86, engaged with the feed rollers shaft 118, moves downwardly to maintain contact with the top sheet through the different sheet feed positions also. In the illustrated embodiment, the distance of the downward movement of the feed rollers 114 from first to lowest, second, position is about 1½ inches. The upward movement of the front of the stack plate 44, during the movement of the top of the sheet stack from first feed position to second feed position, is about two and three/quarter inches.

Existing photocopiers with limited (250–500 sheets) sheet holding capacity can be easily modified to use the larger capacity (1000 sheets) apparatus described. The existing sheet cassette may be removed, and a sheet delivery apparatus like the one described can be mounted in its place. A drive for rotating the feed rollers 114 is obtained by extending the belt 134 driving the feed roller shaft 118 to a convenient inner drive shaft already existing in the machine. The connector pivot plate 122 extending between the drive shaft 126 and the feed roller shaft 118 allows the pivotal movement of the feed rollers 114 that in turn allows the movement of the rollers to follow the lowering feed position of the sheet supporting assembly.

MAJOR ADVANTAGES OF THE INVENTION

The invention described above provides improved reliability in the handling of large stacks of transfer sheets in a sheet delivery apparatus that provides for a continuously lowering feed position. The lowering feed position requires the coordinated downward movement of the feed roller assembly and the sheet stripping assembly. The system in which the invention is used provides also for the movement of the feed roller assembly and the sheet stripping assembly to inoperative positions while the delivery apparatus is loaded with sheets.

The improved reliability in sheet feeding added to the system by the invention when compared to the apparatus illustrated in U.S. Ser. No. 76,575, noted above, is provided partly by the elimination of the angle between the top sheet of the stack and the sheet stripping assembly, which results from using a horizontal stack plate. As explained in the Background portion of the application, this angle continuously changes during reduction of the stack height if a pivoting plate, rather than a level plate, is used to support the stack.

Furthermore, as the front end of a pivoting stack plate moves upwardly, there is an effective horizontal, rearward, displacement of the top of the stack resting on the plate, unless a compensating adjustment is made. The horizontal stack plate of the invention moves only vertically, so that no horizontal displacement of the stack top, and, therefore, no compensating adjustment, must be made.

The cantilever suspension of the horizontal stack plate of the invention on vertical rods by linear bearings at the rear of the plate restrains the plate from horizontal movement and maintains the plate in a substantially level position, independently of the relative forces exerted by the different springs acting on the plate. To the extent that the bearings may bind or hinder the movement of the stack plate (only if the bearings are not acting as they should), the assembly is self-adjusting, since the feed rollers and sheeting stripping assembly automatically drop to the position of the stack top sheet, wherever it is. The precise suspension of the horizontal stack plate shown in the illustrative embodiment may, however, be varied, as long as smooth vertical movement of the plate, with little horizontal displacement, is accomplished.

Moreover, other deletions, additions, subtractions or modifications of the invention would be obvious to one practiced in the art; and they would fall within the scope of the invention as defined in the following claims:

We claim:

1. In a sheet feeding apparatus comprising a feed roller assembly for feeding sheets from a large stack of sheets, having feed rollers movable in a substantially vertical direction between an inoperative upper position and a continuum of operative lower positions in which said feed rollers bear on said sheet stack, and a sheet stripping mechanism movable in response to the position of said feed roller assembly, the improvement comprising:

a sheet supporting assembly having:

an upwardly biased, substantially horizontal sheet stack support plate vertically movably mounted in said sheet supporting assembly, said plate being movable in response to the weight of said sheet stack and the force of said feed rollers bearing thereon in said operative lower positions, and resilient bias means for applying an upward bias to said plate, said bias means having an effective spring constant in the vertical direction that is substantially less than a constant feed position force, whereby as the number of sheets in a stack supplied by said sheet stack support plate decreases, the stack plate moves in an upward direction by a distance less than the thickness of the removed sheets so that the position of the topmost sheet continually lowers.

2. In a sheet feeding apparatus comprising a feed roller assembly for feeding sheets from a large stack of sheets, having feed rollers movable in a substantially vertical direction between an inoperative upper position and a continuum of operative lower positions in which said feed rollers bear on said sheet stack, and a sheet stripping mechanism movable in response to the position of said feed roller assembly, the improvement comprising a sheet supporting assembly having an upwardly biased, substantially horizontal sheet stack support plate, a base means, rod means extending upwardly from said base means, said plate having at least one linear bearing fixed to a rear portion of said plate for slidably supporting said plate in cantilever fashion on said rod means, said plate being thereby vertically movable in response to the weight of said sheet stack and the force of said feed rollers bearing thereon in said operative lower positions, and vertical resilient bias means resiliently extending between said base means and said plate for applying an upward bias to said plate, said bias means having an effective spring constant in the vertical direction that is substantially less than a constant feed position force.

* * * * *